6/9/87 XR 4,671,047

United States Patent [19]

Mugnai

[11] Patent Number: 4,671,047

[45] Date of Patent: Jun. 9, 1987

[54] FORM-FILL-SEAL MACHINE

[75] Inventor: Giorgio Mugnai, Milano, Italy

[73] Assignee: W. R. Grace & Co., Cryovac Div., Duncan, S.C.

[21] Appl. No.: 780,538

[22] Filed: Sep. 26, 1985

[30] Foreign Application Priority Data

Oct. 8, 1984 [GB] United Kingdom ..... 8425357

[51] Int. Cl.[4] ..... B65B 9/06

[52] U.S. Cl. ..... 53/550; 53/578; 493/248; 493/302; 493/476

[58] Field of Search ..... 53/550, 551, 552, 562, 53/578, 558, 574; 493/193, 248, 254, 302, 438, 439, 446, 447, 470, 476

[56] References Cited

U.S. PATENT DOCUMENTS

| | | | |
|---|---|---|---|
| 2,445,703 | 7/1948 | Williams | 493/302 X |
| 2,886,930 | 5/1959 | Martin | 53/550 |
| 3,296,770 | 1/1967 | Wilson | 53/552 |
| 3,335,540 | 8/1967 | Reil et al. | 53/551 X |
| 3,354,799 | 11/1967 | Harrison | 53/552 X |
| 3,482,491 | 12/1969 | Gustafson | 53/551 X |
| 3,962,958 | 6/1976 | Hobart | 53/551 X |
| 4,073,121 | 2/1978 | Greenawalt | 53/552 X |
| 4,185,443 | 1/1980 | Budzyn | 53/550 |
| 4,517,786 | 5/1985 | Barker | 53/550 X |
| 4,529,471 | 7/1985 | Vaughan | 493/302 X |

FOREIGN PATENT DOCUMENTS

| | | | |
|---|---|---|---|
| 36046 | 5/1926 | Netherlands | 493/439 |
| 776590 | 6/1957 | United Kingdom . | |
| 799325 | 8/1958 | United Kingdom . | |
| 2089311 | 6/1982 | United Kingdom . | |
| 2150493 | 7/1985 | United Kingdom . | |

*Primary Examiner*—Robert L. Spruill
*Assistant Examiner*—Steven P. Weihrouch
*Attorney, Agent, or Firm*—John J. Toney; William D. Lee, Jr.; Mark B. Quatt

[57] ABSTRACT

A forming shoulder for an HFFS machine comprises a pair of side wires 3*a* and 3*b* each comprising an upper limb 11 joined to a lower limb 14 at an elbow 12 and each supported near a respective end of a support bar 16. The width of the tube, defined by side walls where the tube passes inwardly of the two lower limbs 14 and by a floor (defined by the marginal portions of the film 10) and a ceiling (defined by the central portion 10*a* of the film spanning the gap between the two elbows 12), is adjustable by re-positioning of the side wires 3*a* and 3*b* on the support bar 16 and the height of the tube is adjustable by replacement of one pair of side wires by a different pair having an alternative geometry.

8 Claims, 5 Drawing Figures

FORM-FILL-SEAL MACHINE

The present invention relates to a machine of the type known as a form-fill-seal machine, and is particularly applicable to the horizontal type of such a machine, known as the "HFFS" machine.

In form-fill-seal machines a continuous web of sealable, normally heat-sealable, plastics film is passed over a forming box which defines a shoulder at which the centre part of the film turns back on itself and the lateral margins of the film become tucked downwardly and brought together to be sealed, eventually to form a tube into which product articles can be fed in a direction generally parallel to that along which the centre portion of the film passes after it has doubled back at the forming shoulder. The forming shoulder is normally a box of metal construction having a solid top wall and slits in the floor to define guideways along which the lateral marginal portions of the film can be threaded and brought together to be sealed as the film is threaded up in the forming box.

The present invention aims to provide a forming shoulder which differs from the conventional box in that it allows rapid adjustability of both the width of the tube of film defined by the shoulder and also adjustability of the height of the tube.

Accordingly, the present invention provides a forming shoulder for a form-fill-seal machine comprising a pair of side members of V-shaped form defining a first pair of respective limbs of the side members each joined to respective second limbs by respective elbows at the apex of the V, and a support member adapted to carry both of the two side members and to be connected thereto by portions of the side members connected to the ends of said first limbs remote from the apex.

A further aspect of the present invention provides an HFFS machine including means for supporting a supply of continuous sealable film, a support table for advancing product articles in a direction of product advance; a forming shoulder for guiding the sealable film in such a manner that the marginal portions of the film become tucked under product articles moving along the support table and become part of a floor of a tube into which the products move at the forming shoulder; means for sealing together the marginal portions of the film downstream of the forming shoulder to complete a tube enveloping the product articles; and means for transversely sealing the tube to complete individual packages moving along said support table; wherein the forming shoulder comprises a pair of side members of V-shape having first limbs generally parallel to the plane of the film moving towards said forming shoulder and second limbs joined to the first limbs by respective elbows, whereby the second limbs guide the film to define side walls to the tube into which the product articles pass at the forming shoulder, the portion of film between said elbows defining the ceiling to said tube.

In order that the present invention may more readily be understood one embodiment thereof will now be described, merely by way of example, with reference to the accompanying drawings in which.

Figure 1:
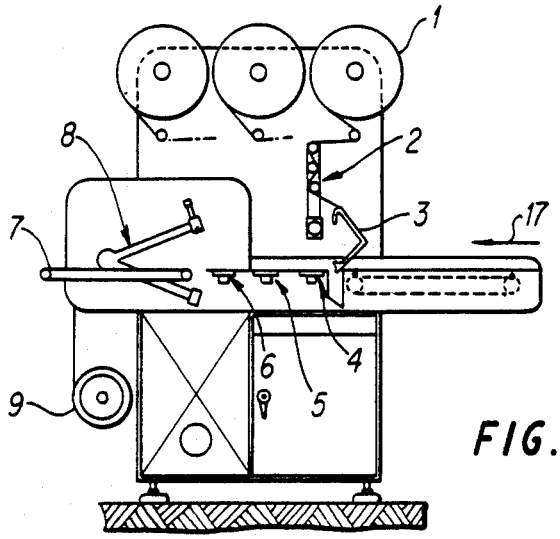
FIG. 1 is a side elevational view of an HFFS machine using the forming shoulder in accordance with the present invention.

FIG. 1 shows film being supplied from a roll 1 over a tensioning roll assembly 2 and thence to the forming shoulder 3. At this point, in the conventional manner, the lateral margins of the film are brought downwardly and into contact with one another (below the plane of the loading table along which the product articles pass in use of the HFFS machine) to be pressed together and dragged forwardly by a first pair of drive rollers 4 below the loading table plane and then sealed by means of a second pair of rollers 5, in this case heated to effect the seal, and finally guided to a severing roller pair 6 where the selvage of the tube is cut away before the continuous film tube with its array of spaced products therealong is fed to a discharge conveyor 7, and the individual packages formed by the tubular film portions around the product articles are severed from one another by a sealing jaw arrangement 8.

While the machine illustrated in FIG. 1 is generally conventional except for the type of forming shoulder 3 used, the sealing and severing rollers 5 and 6 could alternatively be combined in a single trim seal severing unit as disclosed in our British Patent Application No. 8331947 filed 30 Nov. 1983, and the severing and sealing jaw unit 8 may be replaced by the reciprocating transverse sealing device disclosed in our British Patent Application 8333391 filed 15 Dec. 1983.

Finally, the machine of FIG. 1 incorporates a take-up roll 9 for winding up the selvage trimmed by the severing roll pair 6.

Figure 2:
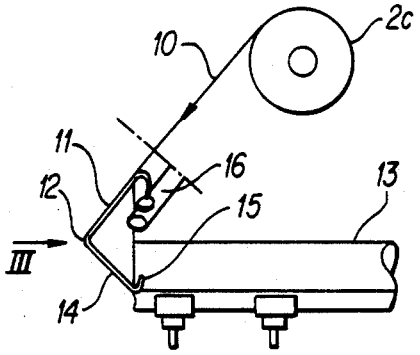
FIG. 2 is a detail showing the forming shoulder and the path of the film from a final guide roller ahead of the shoulder until the film attains its tubular configuration.

FIG. 2 shows the path of the film from a guide roller **2*c* and shows the film 10 passing generally downwardly and parallel to upper limbs 11 of the forming shoulder 3. Elbows 12 of the respective side members 3*a* and 3*b* (FIGS. 3 and 4) of the forming shoulder define the ceiling of the tube 13 to be formed by the shoulder 3 and the forming shoulder further includes lower limbs 14 which define the side walls of the tube. For the sake of simplicity, no product articles are shown within the tube 13, and the tube itself is shown as being of generally circular cross-section; it will of course be understood that in practice the film will adopt a cross-section substantially the same as that of the product articles being conveyed along within it, and this cross-section will as far as possible be defined by the shape of the forming shoulder 3**.

Finally, the lower limbs 14 have upturned ends 15 intended to avoid inadvertent rupture of the tube 13 on the ends of the limbs. Although only one of the two sides of the forming shoulder 3 is shown in FIG. 2, it can be seen that this side member is mounted on a horizontal carrier bar 16 which will of course support another such side member spaced from the first in order to define the width of the tube.

In use of the apparatus, product articles (not shown) will advance along the direction of the arrow 17 in FIG. 1 and this will be generally parallel to the arrow III of FIG. 2, i.e. from left to right in FIG. 2.

Figure 3:
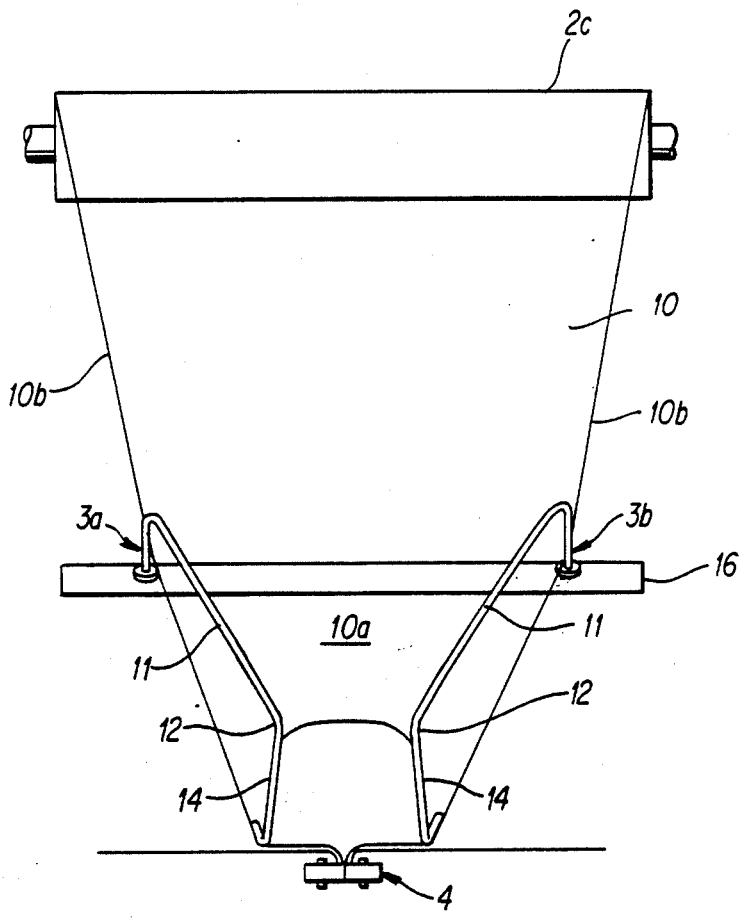
FIG. 3 is a view seen looking along the direction of arrow III of FIG. 2.

An observer looking along the direction of arrow III of FIG. 2 will see the configuration shown in FIG. 3 where the film 10 from the roll **2*c* has its lateral margins 10*b* tucked under and eventually brought into contact with one another between the drive rolls 4. Further-more, the central portion 10***a* of the film 10 spans the gap between the elbows 12 of the two side wires, here referenced 3*a* and 3*b* respectively, to define the ceiling to a tube whose floor is defined by the lateral portion of the film near the margins 10*b*. It will of course be appreciated that whereas the film passes over and around the upper limbs 11 it doubles back on itself to pass inwardly of the lower limbs 14 and thus the lower limbs 14 also serve to define the opening of the tube (along with the central portion 10*a* of the film spanning the gap between the two elbows 12).

As can be seen in FIG. 3, the two side wires 3*a* and 3*b* mounted on the carrier bar 16 are able to be positioned at various alternative locations along the bar 16 in order to vary the width of the forming shoulder 3, as will be explained in more detail with reference to FIG. 4. Likewise, the individual wires 3*a* and 3*b* can be replaced by wires of a different design in order to allow the height of the product line and even the cross-sectional form of the tube 13 to be changed.

Figure 4:
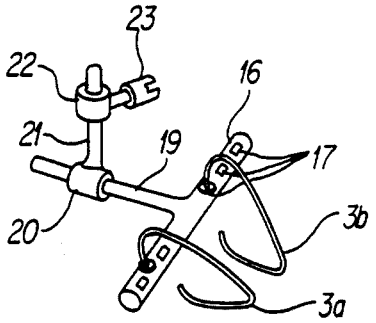
FIG. 4 is a perspective view of the forming shoulder according to the invention.
Figure 5:
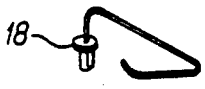
FIG. 5 is a perspective view of one of the replaceable side elements of the forming shoulder of FIG. 4.

FIG. 4 shows the central support bar 16 as having at each end three alternative sockets 17 into which a plug 18 (see FIG. 5) of the support wire 3*a* or 3*b* can fit. As shown in FIG. 4, it is not essential for the two support wires 3*a* and 3*b* always to be symmetrically arranged around the mid-point of the support bar 16 and thus, with this possibility of a symmetrical mounting of the wires 3*a* and 3*b*, there are six possible alternative widths of the shoulder 3.

FIG. 4 also shows the support bar 16 as having a central support stem 19 clamped at 20 to a vertical bar 21 which is in turn clamped at 22 to a support member 23. This enables the position of the support bar 16 along the direction of product advance and its level above the loading table to be adjusted, and provides an almost infinite number of possibilities for the height, inclination and lateral positioning of the support bar 16, as desired.

When setting up the support wires 3*a* and 3*b* of the forming shoulder, it is important to align the upper limbs 11 so as to be substantially parallel to the plane of the run of film 10 between the roll 2*c* and the elbow 12, in order to provide optimum guidance of the film by spreading the area of contact of the film along the length of the limbs 11.

The height of the finished tube 13 can be changed by replacing one pair of side wires 3*a* and 3*b* with another pair having longer lower limbs 14. Generally the angle of inclination of the lower limbs 14 will be chosen to provide optimum guidance of the side wall of the tube 13 and to minimise film tension over the limbs 14 in order to cut down on frictional drag on the film. For this same reason, the side wires 3*a* and 3*b* are preferably formed of circular cross-section wire which may advantageously include a low friction surface coating.

I claim:

1. A forming shoulder for a form-fill-seal machine comprising:

(a) a pair of elongate side bars of V-shaped form, each of said side bars including a first limb joined to a second limb by an elbow at the apex of the V;

(b) side bar mounting portions connected to the ends of said first limbs remote from the apices of the respective Vs;

(c) a support member adapted to carry both of the two side bars and to be connected thereto, said side bars being mounted on the support member so as to have their apices close together than are any other points of the said first limbs.

2. A forming shoulder according to claim 1, wherein each of the elongate side bars is formed of circular section wire.

3. A forming shoulder according to claim 2 wherein said carrier means comprises an elongate carrier member which includes, disposed about a central portion of the carrier member, a plurality of fixing points for the side bars.

4. A forming shoulder according to claim 3, wherein each side bar includes a further limb connected to the free end of said first limb thereof and, at the free end of this further limb, a mounting portion for engagement with the support means.

5. A forming shoulder according to claim 4, wherein the mounting portion of said further limb is shaped to prevent rotation of the respective side member with respect to the support means.

6. A forming shoulder according to claim 5, and including means for mounting the support means on a form-fill-seal machine with provision for varying the position of the support means along the direction of product movement, and for varying the height of the support means perpendicular to the plane of a product support table of the form-fill-seal machine.

7. A horizontal form-fill-seal machine including:

(a) means for supporting a supply of continuous sealable film;

(b) a support table for advancing product articles in a direction of product advance;

(c) a forming shoulder for guiding the sealable film in such a manner that the marginal portions of the film become tucked under product articles moving along the support table and become part of a floor of the tube into which the products move at the forming shoulder;

(d) means for sealing together the marginal portions of the film downstream of the forming shoulder to complete a tube enveloping the product articles; and, (e) means for transversely sealing the tube to complete individual packages moving along said support table wherein the forming shoulder comprises a pair of side bars of V-shape having first limbs generally parallel to the plane of the film moving towards said forming shoulder and second limbs joined to the first limbs by respective elbows, whereby the second limbs guide the film to define side walls to the tube into which the product articles pass at the forming shoulder, the portion of film between said elbows defining the ceiling to said tube, and wherein the film approaches the product support table along a first direction having a first component of movement perpendicularly towards said support table, and a second component of movement along the support table in a direction directly opposed to said direction of product advance.

8. A horizontal-form-fill-seal machine according to claim 7, wherein the forming shoulder defines only the front edges of the side walls at the mouth of the tube being formed, the front of the floor of the tube being defined, in use, by the marginal parts of the film being guided inwardly to converge towards a pair of nip walls under the support tube, whereby product articles entering the tube mouth rest directly on said converging marginal film parts.

* * * * *